US011519402B2

(12) United States Patent
Burrows

(10) Patent No.: US 11,519,402 B2
(45) Date of Patent: Dec. 6, 2022

(54) ELECTRIC DRIVEN GAS BOOSTER

(71) Applicant: Haskel International, LLC, Burbank, CA (US)

(72) Inventor: Brian A. Burrows, Granada Hills, CA (US)

(73) Assignee: HASKEL INTERNATIONAL, LLC, Burbank, CA (US)

( * ) Notice: Subject to any disclaimer, the term of this patent is extended or adjusted under 35 U.S.C. 154(b) by 483 days.

(21) Appl. No.: 15/851,100

(22) Filed: Dec. 21, 2017

(65) Prior Publication Data

US 2019/0195213 A1 Jun. 27, 2019

(51) Int. Cl.

| | |
|---|---|
| ***F04B 39/06*** | (2006.01) |
| ***F04B 25/00*** | (2006.01) |
| ***F04B 39/10*** | (2006.01) |
| ***F04B 37/12*** | (2006.01) |
| ***F04B 39/00*** | (2006.01) |
| ***F04B 9/02*** | (2006.01) |

(Continued)

(52) U.S. Cl.

CPC ..... *F04B 39/064* (2013.01); *F04B 9/02* (2013.01); *F04B 25/005* (2013.01); *F04B 35/04* (2013.01); *F04B 37/12* (2013.01); *F04B 39/0005* (2013.01); *F04B 39/1046* (2013.01); *F04B 49/065* (2013.01); *F04B 2201/0201* (2013.01); *F04B 2201/08* (2013.01); *F04B 2205/18* (2013.01)

(58) Field of Classification Search

CPC ..... F04B 9/02; F04B 35/045; F04B 9/1256; F04B 49/065; F04B 35/04; F04B 39/064; F04B 2201/0201; F04B 2201/08; F04B 2205/18; F15B 9/03; F15B 3/00; E21B 33/0355

See application file for complete search history.

(56) References Cited

U.S. PATENT DOCUMENTS 3,771,912 A * 11/1973 Conlee ..... F04B 53/14 417/397

4,145,165 A 3/1979 Perkins et al.

(Continued)

FOREIGN PATENT DOCUMENTS

| | | |
|---|---|---|
| CA | 2514817 A1 | 2/2007 |
| CN | 1363770 A | 8/2002 |

(Continued)

OTHER PUBLICATIONS

Extended European Search Report dated Feb. 18, 2019 for Application No. 18214730.6, 8 pages.

(Continued)

*Primary Examiner* — Devon C Kramer
*Assistant Examiner* — Lilya Pekarskaya
(74) *Attorney, Agent, or Firm* — Edell, Shapiro & Finnan, LLC

(57) ABSTRACT

A gas booster for increasing a pressure of a gas includes a gas cylinder and a drive. The gas cylinder defines a chamber having an inlet and an outlet. A piston is actuatable within the gas cylinder to draw gas into the chamber through the inlet at a first pressure and to push the gas out of the chamber through the outlet at a second pressure that is higher than the first pressure. The drive includes an electric motor coupled to the piston of the gas cylinder by a mechanical connection to actuate the piston.

14 Claims, 13 Drawing Sheets

(51) Int. Cl.

| | |
|---|---|
| ***F04B 49/06*** | (2006.01) |
| ***F04B 35/04*** | (2006.01) |

(56) References Cited

U.S. PATENT DOCUMENTS

| | | | | | |
|---|---|---|---|---|---|
| 4,653,986 | A * | 3/1987 | Ashton | F04B 49/002 | 417/243 |
| 4,761,118 | A * | 8/1988 | Zanarini | F04B 9/115 | 417/396 |
| 5,094,596 | A * | 3/1992 | Erwin | F04B 15/02 | 417/397 |
| 5,273,405 | A * | 12/1993 | Chalmers | F01L 25/08 | 417/397 |
| 5,570,769 | A * | 11/1996 | Eicher | B25J 9/101 | 192/143 |
| 5,628,496 | A * | 5/1997 | Chamberlin | F16F 9/368 | 188/269 |
| 6,068,448 | A | 5/2000 | Muratsubaki et al. | | |
| 6,139,288 | A * | 10/2000 | Karasawa | F04B 17/042 | 417/415 |
| 8,845,298 | B2 * | 9/2014 | Larsen | F04B 43/09 | 417/2 |
| 9,127,659 | B2 * | 9/2015 | Kitchener | F04B 49/065 | |
| 9,551,328 | B2 * | 1/2017 | Frey | F04B 17/042 | |
| 9,816,497 | B2 * | 11/2017 | Strickland | F04B 25/04 | |
| 2008/0223206 | A1 * | 9/2008 | Igarashi | F15B 3/00 | 92/12.1 |
| 2009/0311114 | A1 | 12/2009 | Schulz et al. | | |
| 2010/0158717 | A1 * | 6/2010 | Vogt | F04B 25/02 | 417/401 |
| 2011/0219763 | A1 * | 9/2011 | McBride | H02J 15/006 | 60/526 |
| 2013/0167697 | A1 * | 7/2013 | Reukers | F04B 49/065 | 83/53 |
| 2014/0271262 | A1 * | 9/2014 | Frey | F04B 17/042 | 417/302 |
| 2016/0076526 | A1 | 3/2016 | Reukers | | |
| 2017/0067455 | A1 | 3/2017 | Reukers et al. | | |
| 2017/0138913 | A1 | 5/2017 | Nocon et al. | | |

FOREIGN PATENT DOCUMENTS

| | | | |
|---|---|---|---|
| EP | 2616690 | A1 | 7/2013 |
| JP | H10-281056 | A | 10/1998 |
| JP | H10-288158 | A | 10/1998 |
| JP | 2007-056766 | A2 | 3/2007 |
| JP | 2007-120341 | | 5/2007 |
| WO | WO 2009/117765 | A1 | 1/2009 |

OTHER PUBLICATIONS

Notification of the First Office Action for Chinese Patent Application No. 2018115663123 with English translation and Search Report dated Sep. 9, 2021, 13 pages.

Second Office Action for Chinese Patent Application No. 2018115663123 with English translation and Search Report dated Apr. 21, 2022, 20 pages.

Notification of Reasons for Refusal for Japanese Patent Application No. 2018-238024 with English translation dated Jan. 25, 2022, 12 pages.

Office Action for Korean Patent Application 10-2018-0165954 dated Sep. 22, 2022 with English translation, 14 pages.

* cited by examiner

ELECTRIC DRIVEN GAS BOOSTER

TECHNICAL FIELD

The present disclosure is directed to an apparatus and method to drive a gas booster pump.

BACKGROUND OF THE INVENTION

Booster pumps may be used to increase the pressure of a fluid, such as gas. A booster generally comprises one or more stages having a piston housed within a cylinder that is driven by a motor to compress gas in the cylinder. This may thereby increase the pressure of the gas in the cylinder. The motor of the booster is typically driven by a pneumatic or hydraulic assembly.

For instance, an example of a two-stage booster (40) is shown in FIGS. 1A-1C, which comprises a low-pressure piston (66) housed within a low-pressure cylinder (60) and a high-pressure piston (76) housed within a high-pressure cylinder (70). Each of these pistons (66, 76) may be actuated by a motor (50) comprising a drive piston (56). In the illustrated embodiment, the low-pressure piston (66) is coupled to the drive piston (56) by a low-pressure rod (51) and the high-pressure piston (76) is coupled to the drive piston (56) by a high-pressure rod (53). Accordingly, when the drive piston (56) is translated to the right, toward the high-pressure cylinder (70), the low-pressure piston (66) may be actuated to the right by the low-pressure rod (51), into the low-pressure cylinder (60), to draw gas from a low-pressure gas storage tank (32) at a low pressure into the low-pressure gas chamber (64) of the low-pressure cylinder (60) through inlet piping (34) and a low-pressure inlet check valve (61), as shown in FIG. 1A. The drive piston (56) may then be translated to the left, toward the low-pressure cylinder (60), as shown in FIG. 1B. This may actuate the low-pressure piston (66) to the left, outward in the low-pressure cylinder (60), to compress the gas in the low-pressure gas chamber (64) to an intermediate pressure and to push the gas out of the low-pressure gas chamber (64) through a low-pressure outlet check valve (62). The gas may then travel through intermediate piping (69) to the high-pressure cylinder (70). As the low-pressure piston (66) is actuated to the left, the high-pressure piston (76) may also be actuated to the left by the high-pressure rod (53), into the high-pressure cylinder (70) to draw gas from the intermediate piping (69) into the high-pressure gas chamber (74) of the high-pressure cylinder (70) through a high-pressure inlet check valve (71). The drive piston (56) may then be translated to the right again, toward the high-pressure cylinder (70), as shown in FIG. 1C. This again may actuate the low-pressure piston (66) to the right, into the low-pressure cylinder (60), to draw gas from a low-pressure gas storage tank (32) into the low-pressure gas chamber (64) of the low-pressure cylinder (60). The high-pressure piston (76) may also be translated to the right by the high-pressure rod (53), outward in the high-pressure cylinder (70), to compress the gas in the high-pressure gas chamber (74) to a high pressure and to push the gas out of the high-pressure gas chamber (74) through a high-pressure outlet check valve (72) and to a high-pressure gas storage tank (36) through outlet piping (38). The pistons (56, 66, 76) can continue to cycle to thereby produce a stream of high-pressure gas from the booster (40). In some versions, a heat exchanger (68, 78) and/or cooling jackets (65, 75) are provided around the intermediate piping (69) and/or the gas cylinders (60, 70) to cool the gas.

The motor (50) of such boosters (40) are typically driven by a separate pneumatic or a hydraulic system. For instance, FIGS. 1A-1C show an example of a separate drive system (20) for a booster (40), which comprises a source tank (22) coupled to a drive pump (24) by drive piping (21). The drive pump (24) may then be coupled to a first chamber (52) of the motor (50), adjacent to the low-pressure cylinder (60), by first piping (23) and to a second chamber (54) of the motor (50), adjacent to the high-pressure cylinder (70), by second piping (25). The source tank (22) comprises a fluid, either air or hydraulic fluid, that may be pumped to either the first chamber (52) or the second chamber (54) of the motor (50) by the drive pump (24) to actuate the motor (50). Accordingly, when the drive pump (24) pumps the fluid into the first chamber (52), the drive piston (56) may be translated to the right, toward the high-pressure cylinder (70). When the drive pump (24) pumps fluid into the second chamber (54), the drive piston (56) may be translated to the left, toward the low-pressure cylinder (60). Fluid may be discharged from the chambers (52, 54) and returned to the source tank (22) and/or vented to the atmosphere. Such pneumatic or hydraulic drive systems may be costly due to the amount of parts of the separate drive system and they may experience energy losses due to pneumatic or hydraulic pressure drops.

Accordingly, there is a need to provide a more efficient method to drive a gas booster.

BRIEF SUMMARY OF THE INVENTION

An electric driven gas booster is provided having a direct mechanical connection between an electric motor and the gas piston to eliminate the need for a separate pneumatic or hydraulic drive system. Accordingly, equipment costs may be reduced because separate drive system equipment may be no longer needed, such as air compressors, air storage tanks, compressed air transport lines, hydraulic power units, hydraulic storage tanks, hydraulic valves, high pressure hydraulic plumbing, etc. Energy losses due to pneumatic and hydraulic pressure drops may also be eliminated. A more efficient gas booster may thereby be provided with reduced cooling and electrical requirements.

In one embodiment, a gas booster for increasing a pressure of a gas may comprise a first gas cylinder and a drive. The first gas cylinder may comprise a first chamber having a first inlet and a first outlet, and a first piston actuatable within the first gas cylinder, wherein the first piston may be configured to draw the gas into the first chamber through the first inlet at a first pressure and to push the gas out of the first chamber through the first outlet at a second pressure that is higher than the first pressure. The drive may comprise an electric motor configured to convert electric energy to linear motion, wherein the electric motor may be coupled to the first piston of the first gas cylinder by a first mechanical connection to actuate the first piston. The electric motor may comprise a ball screw drive. The first mechanical connection may comprise a rod having a first end and a second end, wherein the first end is coupled with the electric motor and the second end is coupled with the first piston of the first gas cylinder such that the first piston is configured to translate with the linear motion of the electric motor. The first gas cylinder may comprise an end cap at a first end portion of the first gas cylinder and an adapter at a second end portion of the first gas cylinder, wherein the adapter is couplable with a housing of the drive to maintain the position of the first gas cylinder relative to the drive, and wherein a plurality of tie rods is positioned between the end cap and the adapter to maintain the position of the end cap relative to the adapter.

The first gas cylinder may comprise an end cap at a second end portion of the first gas cylinder, wherein a plurality of tie rods is positioned between the end cap and the adaptor to maintain the position of the end cap relative to the adapter. The first gas cylinder may comprise a first one-way check valve at the first inlet configured to allow gas to flow into the first chamber and a second one-way check valve at the first outlet configured to allow gas to flow out of the first chamber. The first gas cylinder may comprise a second chamber on an opposing side of the first piston from the first chamber, wherein the second chamber has a second inlet and a second outlet. The first gas cylinder may comprise a third one-way check valve at the second inlet configured to allow gas to flow into the second chamber and a fourth one-way check valve at the second outlet configured to allow gas to flow out of the second chamber. The first gas cylinder may comprise a cooling jacket positioned around the first chamber configured to lower a temperature of the gas within the first chamber.

In some versions, the gas booster may comprise a second gas cylinder. The second gas cylinder may comprise a second chamber having a second inlet and a second outlet, and a second piston actuatable within the second gas cylinder, wherein the second piston is configured to draw the gas into the second chamber through the second inlet at the second pressure and to push the gas out of the second chamber through the second outlet at a third pressure that is higher than the second pressure. The electric motor may be coupled to the second piston of the second gas cylinder by a second mechanical connection to actuate the second piston. The second mechanical connection may comprise a rod having a first end and a second end, wherein the first end is coupled with the electric motor and the second end is coupled with the second piston of the second gas cylinder such that the second piston is configured to translate with the linear motion of the electric motor. The gas booster may comprise piping fluidly coupling the first outlet of the first gas cylinder with the second inlet of the second gas cylinder, wherein the piping may comprise a heat exchanger configured to cool a temperature of the gas between the first gas cylinder and the second gas cylinder. The gas booster may be configured to increase the pressure of the gas up to 15,000 psi, such as from about 100 psi to about 7,000 psi. The gas booster may have a compression ratio of up to about 64, such as between about 40 and 50. One or both of the first gas cylinder and the second gas cylinder may be configured to draw in vacuum through the first inlet and the second inlet.

In another embodiment, a gas booster for increasing a pressure of a gas may comprise a gas cylinder, a drive, and a controller. The gas cylinder may comprise a chamber having an inlet and an outlet, and a piston actuatable within the gas cylinder, wherein the piston is configured to draw the gas into the chamber through the inlet at a first pressure and to push the gas out of the chamber through the outlet at a second pressure that is higher than the first pressure. The drive may comprise an electric motor configured to convert electric energy to linear motion, wherein the electric motor is coupled to the piston of the gas cylinder by a mechanical connection to actuate the piston. The controller may be programmable to selectively activate the electric motor to thereby actuate the piston. The controller may be programmable to selectively control a select one or more of a position of the piston, a maximum piston force, a speed of the piston, and an acceleration of the piston. The controller may comprise wireless capabilities to allow a remote connection to the controller via the internet. The gas booster may comprise at least one pressure sensor configured to measure a pressure of the gas booster, wherein the controller is programmable to selectively actuate the piston based on the measured pressure from the at least one pressure sensor.

In another embodiment, a method for operating a gas booster comprising a gas cylinder defining a chamber having an inlet and an outlet and a piston actuatable within the gas cylinder, wherein the gas booster comprises a drive having an electric motor coupled to the piston of the gas cylinder, may comprise the steps of: translating the piston inward within the gas cylinder to draw gas into the chamber through the inlet by applying electrical energy to the electric motor; and translating the piston outward within the gas cylinder to push gas out of the chamber through the outlet by applying electrical energy to the electric motor, wherein a pressure of the gas is higher at the outlet of the gas cylinder than at the inlet of the gas cylinder. The electric motor may comprise a ball screw drive that converts the electrical energy to a rotary motion and that converts the rotary motion to a linear motion to thereby translate the piston within the gas cylinder. The gas cylinder may be longitudinally aligned with the drive along an axis, wherein the piston of the gas cylinder is coupled with the electric motor of the drive with a mechanical connection positioned along the axis such that the electric motor actuates the piston along the axis. The electrical energy may be selectively applied by a controller.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Figure 1A:
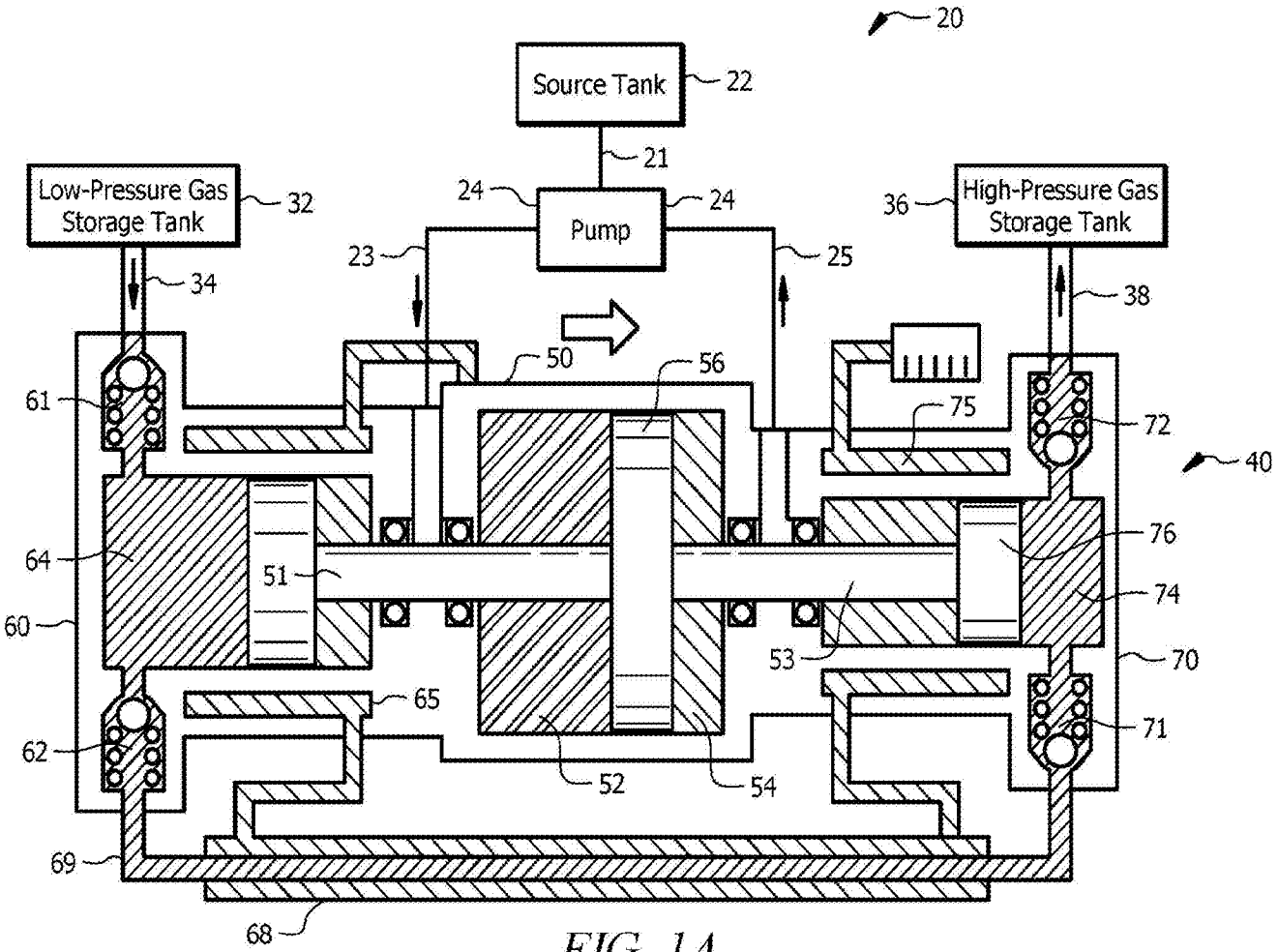
FIG. 1A Prior Art
FIG. 1A depicts a schematic of a two-stage gas booster being actuated by a separate drive system to translate a drive piston of the booster to pull gas into a low-pressure cylinder.
Figure 1B:
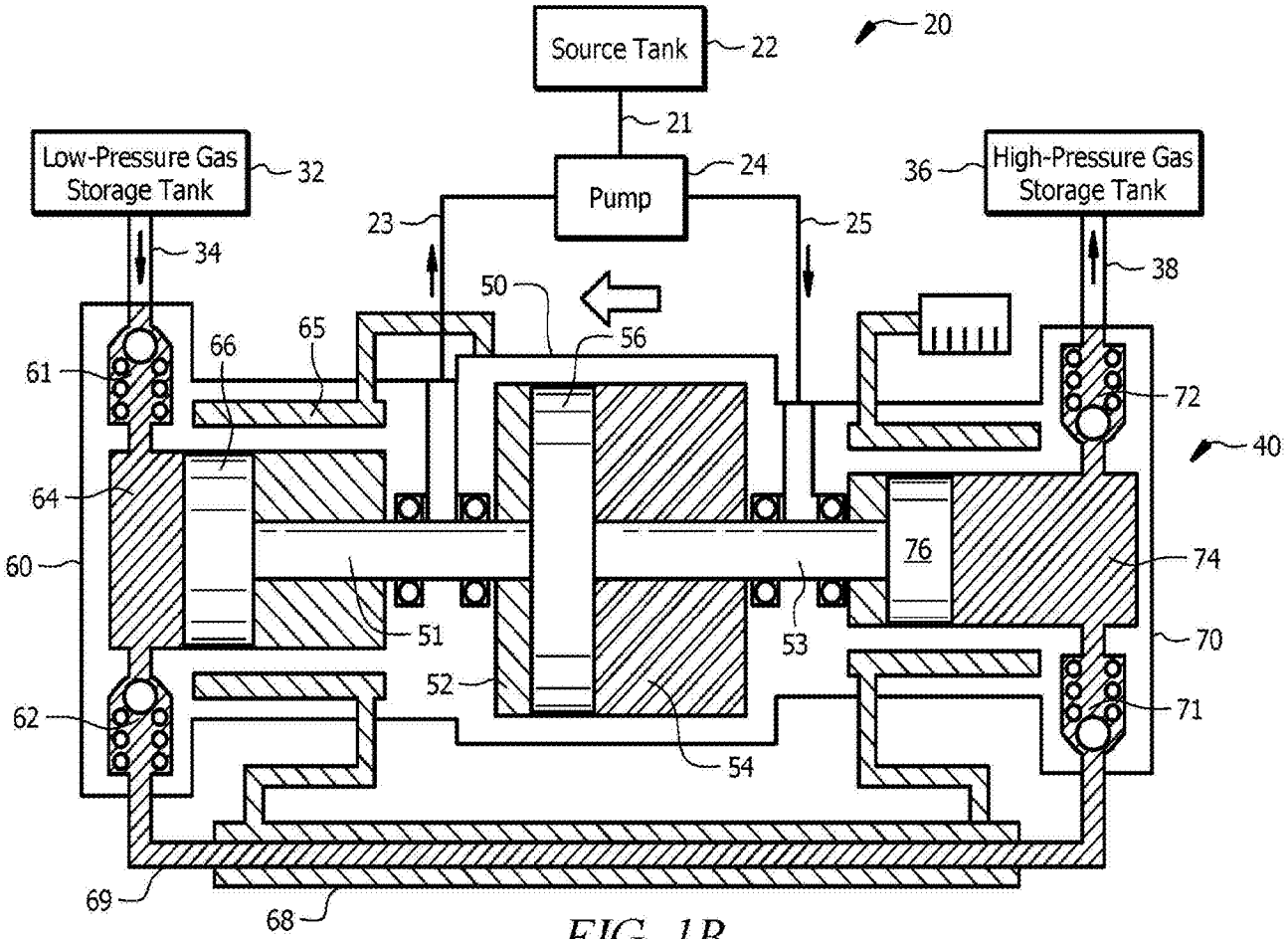
FIG. 1B Prior Art
FIG. 1B depicts a schematic of the booster of FIG. 1A being further actuated by the drive system to translate the drive piston to push gas out of the low-pressure cylinder and into a high-pressure cylinder.
Figure 1C:
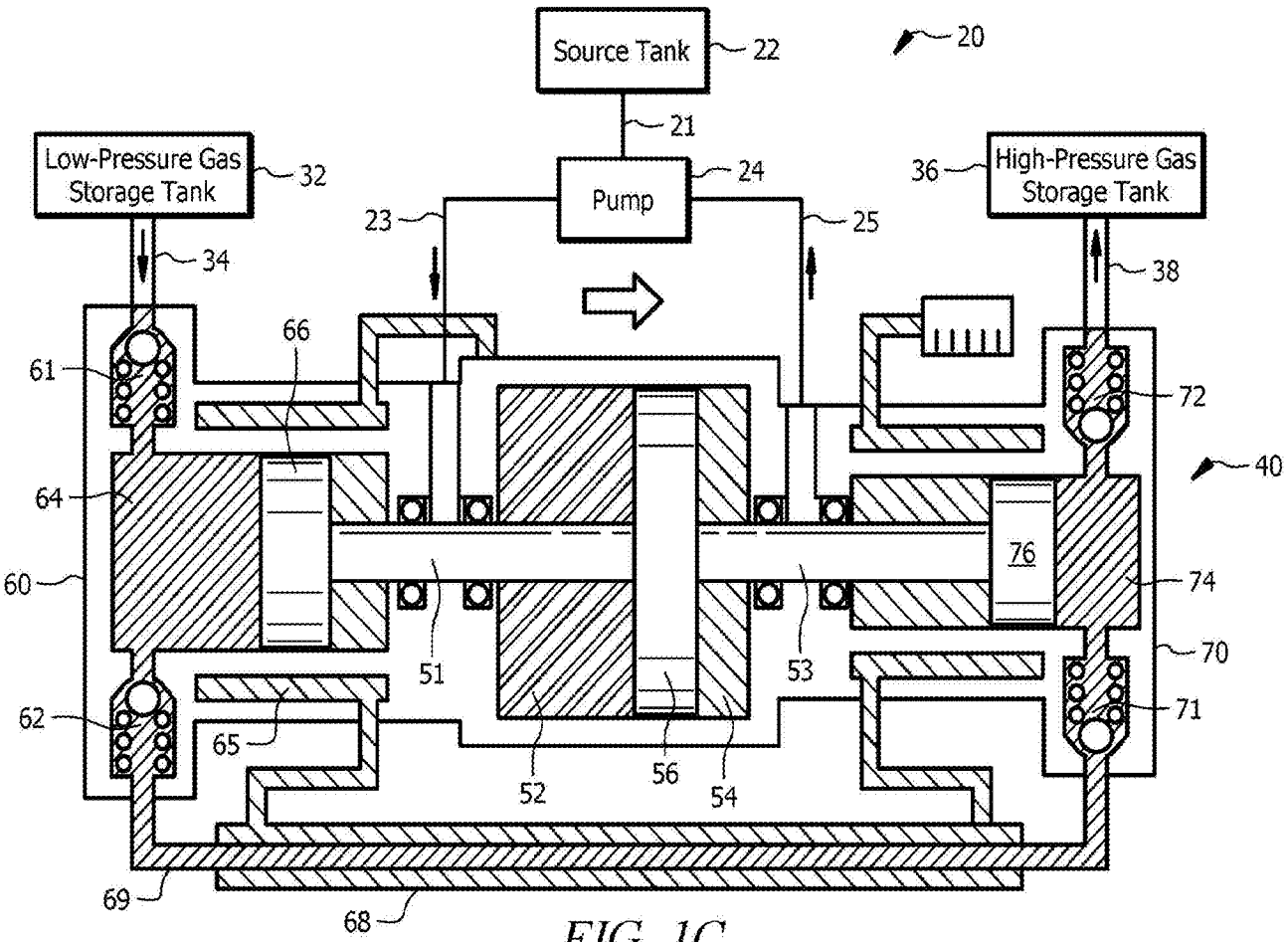
FIG. 1C Prior Art
FIG. 1C depicts a schematic of the booster of FIG. 1A being further actuated by the drive system to translate the drive piston to push gas out of the high-pressure cylinder and again into the low-pressure cylinder.
Figure 2:
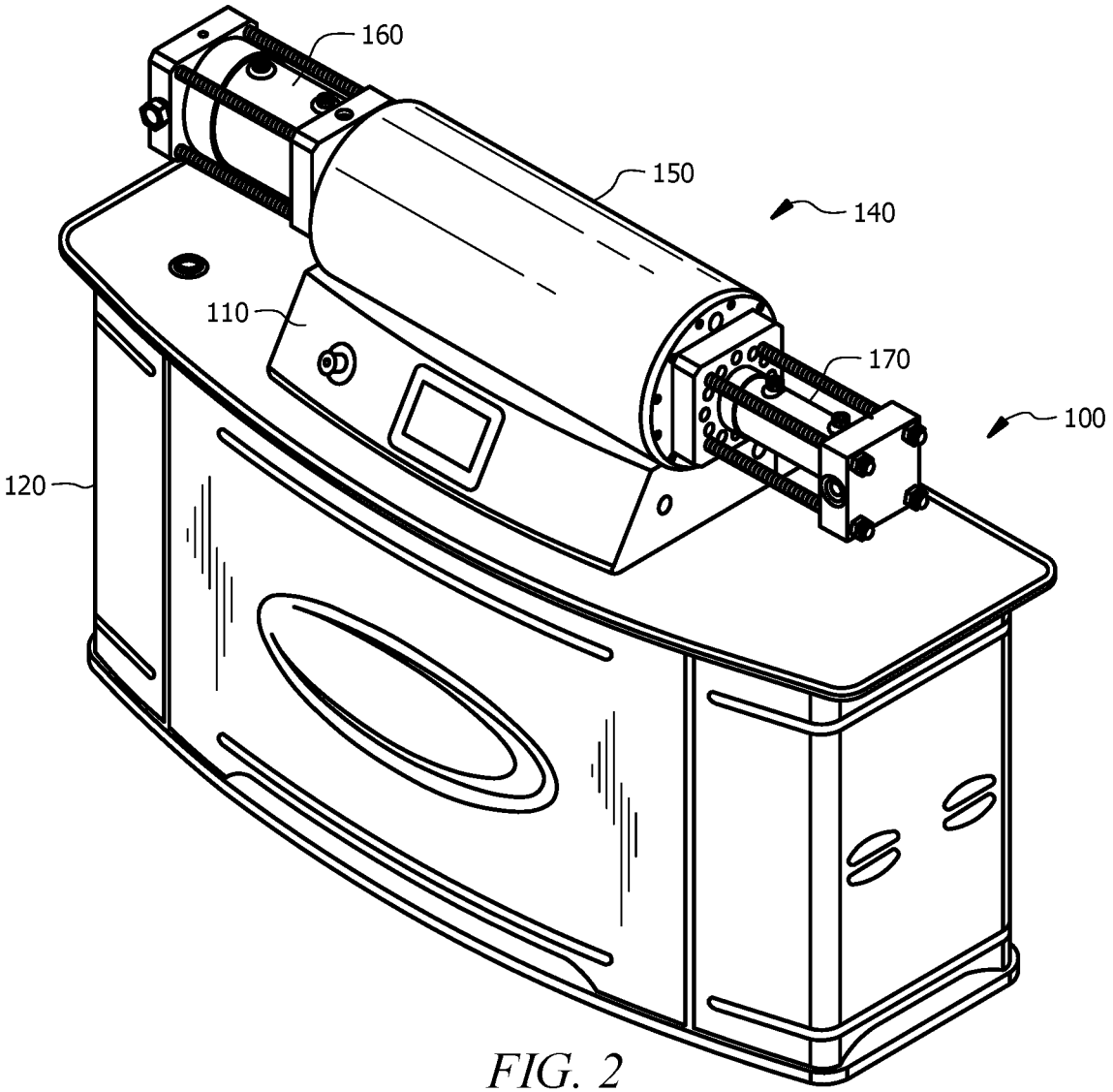
FIG. 2 depicts a perspective view of an electric driven gas booster assembly.

Referring now to FIG. 2, an exemplary gas booster assembly using an electric driven gas booster is described. For instance, the gas booster assembly (100) comprises a gas booster (140) coupled with a controller (110) and positioned on a cabinet (120). The gas booster (140) of the illustrated embodiment comprises two-stages having a low-pressure cylinder (160) and a high-pressure cylinder (170) actuated by an electric motor (150). It should be noted that while a two-stage gas booster (140) is described, any suitable number of one or more stages can be used.

Figure 3:
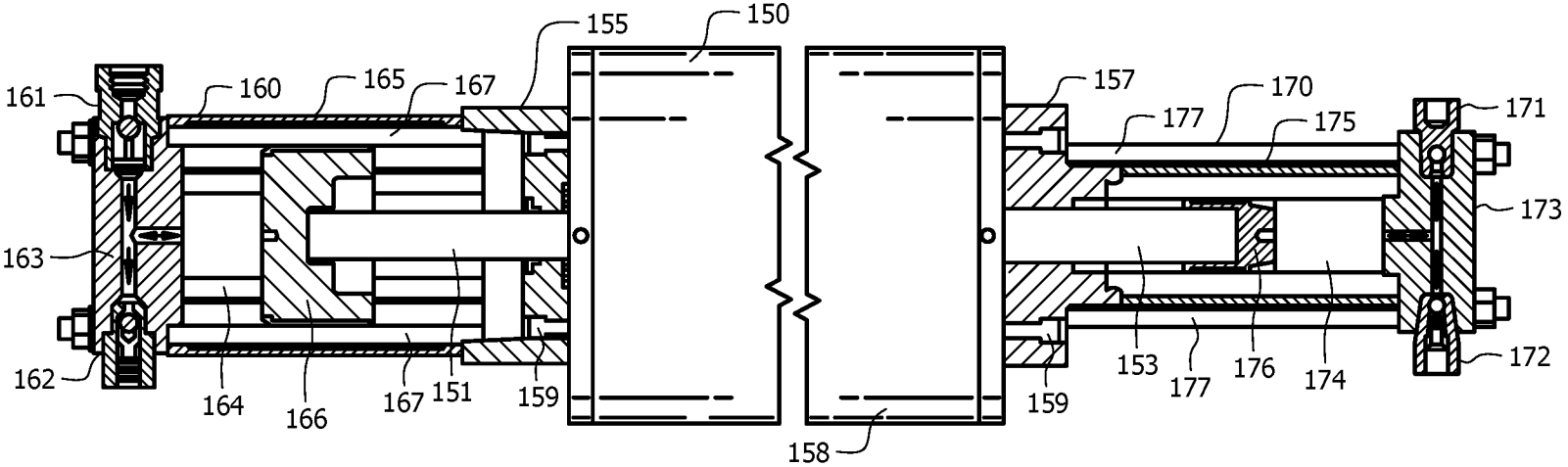
FIG. 3 depicts a top plan view of an electric driven gas booster of the electric driven gas booster assembly of FIG. 2.
Figure 4:
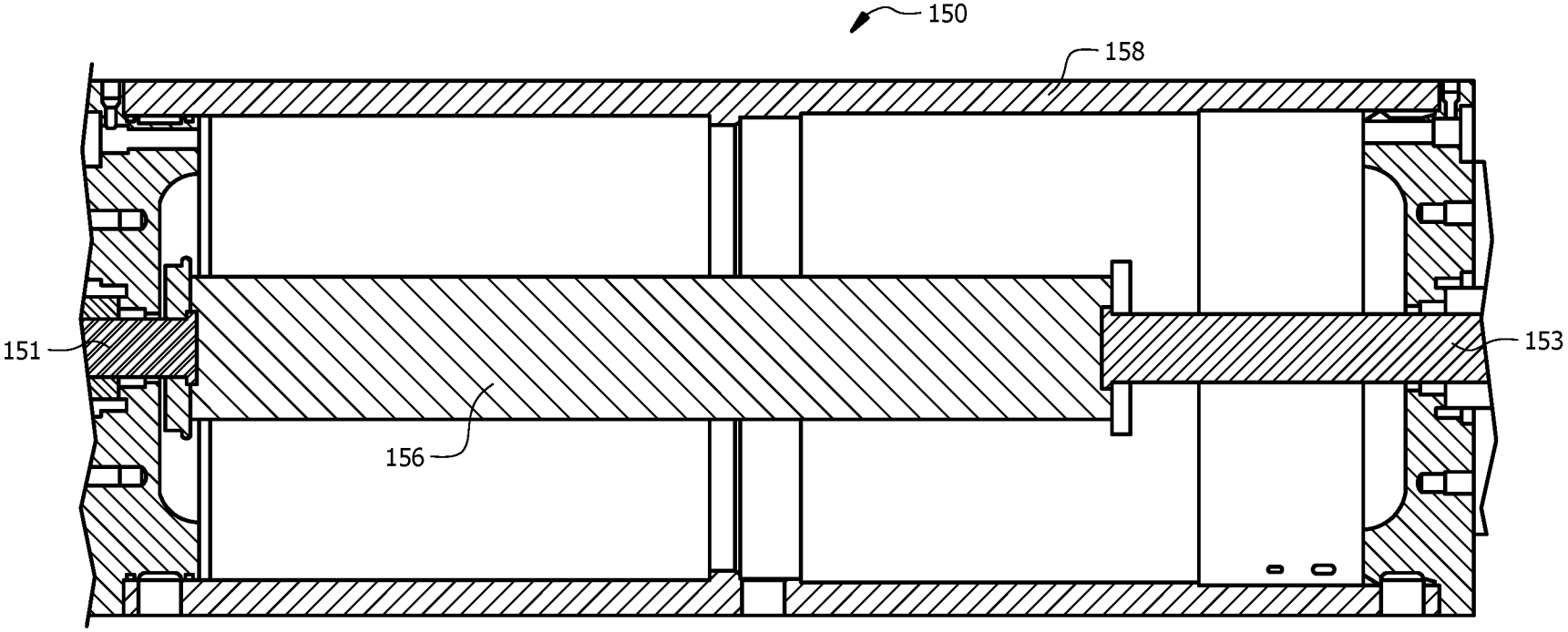
FIG. 4 depicts a cross-sectional view of a motor of the electric driven gas booster of FIG. 3.

As best seen in FIGS. 3 and 4, the motor (150) comprises a housing (158) that is substantially cylindrical with a first end coupled with the low-pressure cylinder (160) and a second end coupled with the high-pressure cylinder (170). A drive (156) is then positioned within the housing (158) that is configured to convert electrical energy into linear motion. For instance, the drive (156) may comprise a ball screw drive having a ball screw and a ball nut with recirculating ball bearings. The interface between the ball screw and the nut may be made by ball bearings that roll in matching ball forms. With rolling elements, the ball screw drive may have a low friction coefficient. Such a ball screw drive can thereby convert electrical energy to rotary motion and then to linear motion. The drive (156) may have a power of between about 20 horsepower and about 60 horsepower to produce at least about 11,500 lbf of force. The drive (156) may further have a maximum speed of about 100 strokes per minute and a life of about 20,000 hours at about 100% duty cycle. The drive (156) may have an about 480 Volt maximum such that if the drive (156) is supplied with 240 Volts, the maximum speed of the drive (156) may be reduced by half while maintaining a maximum force. The voltage of the drive (156) may be configured with either 50 or 60 Hz without the need to change components. Other suitable configurations for the drive (156) will be apparent to one with ordinary skill in the art in view of the teachings herein. In some versions, the drive (156) may be a ball screw drive supplied by Techni Waterjet. A first end of the drive (156) is then coupled to the low-pressure cylinder (160) via the low-pressure rod (151), and a second end of the drive (156) is coupled to the high-pressure cylinder (170) via the high-pressure rod (153), to actuate the booster (140). Still other suitable configurations for driving the motor (150) will be apparent to one with ordinary skill in the art in view of the teachings herein.

Figure 5:
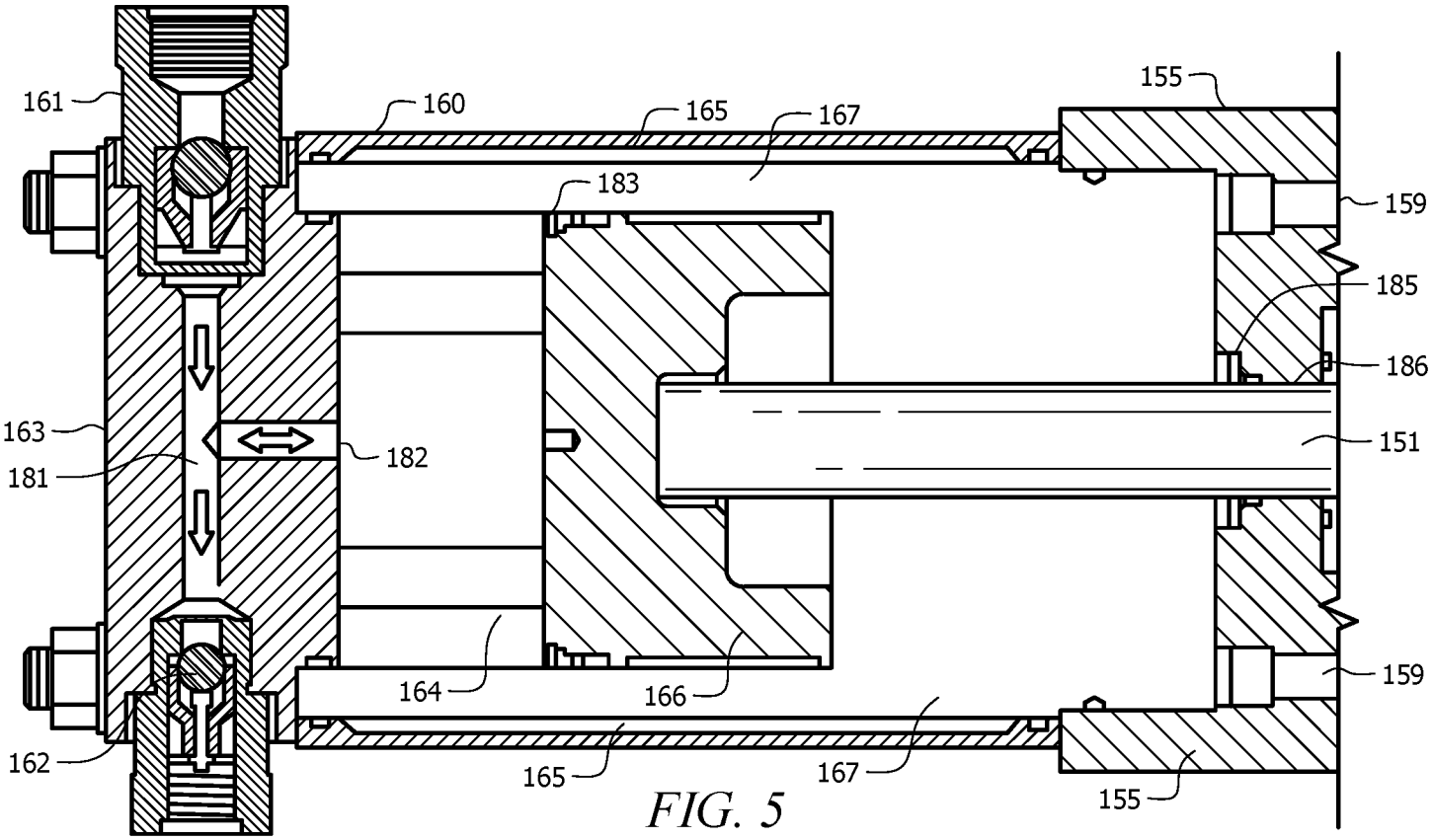
FIG. 5 depicts a cross-sectional view of a low-pressure cylinder of the electric driven gas booster of FIG. 3.

The low-pressure cylinder (160) is shown in more detail in FIGS. 3 and 5. The low-pressure cylinder (160) comprises a low-pressure piston (166) coupled to the other end of the low-pressure rod (151) that translates between a low-pressure end cap (163) and a low-pressure adapter (155) of the low-pressure cylinder (160). A low-pressure chamber (164) is defined between the low-pressure piston (166) and the low-pressure end cap (163). In present embodiment, the low-pressure end cap (163) comprises a low-pressure inlet check valve (161) that allows gas to flow into the low-pressure cylinder (160) from a low-pressure gas storage tank (32), but not to flow out of the low-pressure cylinder (160). The low-pressure end cap (163) further comprises a first conduit (181) with a first end coupled with the low-pressure inlet check valve (161) and a second end coupled with a low-pressure outlet check valve (162) that allows gas to flow out of the low-pressure cylinder (160), but not into the low-pressure cylinder (160). A second conduit (182) is coupled with the first conduit (181) in the low-pressure end cap (163) between the check valves (161, 162) having an outlet to the low-pressure chamber (164) that allows gas to flow between the low-pressure chamber (164) and the first conduit (181). The low-pressure end cap (163) is attached to the low-pressure adapter (155) of the low-pressure cylinder (160) by tie rods (167). While four tie rods (167) are shown in the illustrated embodiment, any other suitable number of tie rods (167) can be used. Each tie rod (167) can have a diameter of about ¾ inches, but any other suitable dimensions can be used. In some versions, the low-pressure cylinder (160) comprises a cooling jacket (165) positioned around the low-pressure cylinder (160) to lower the temperature of the gas within the low-pressure cylinder (160).

Figure 7:
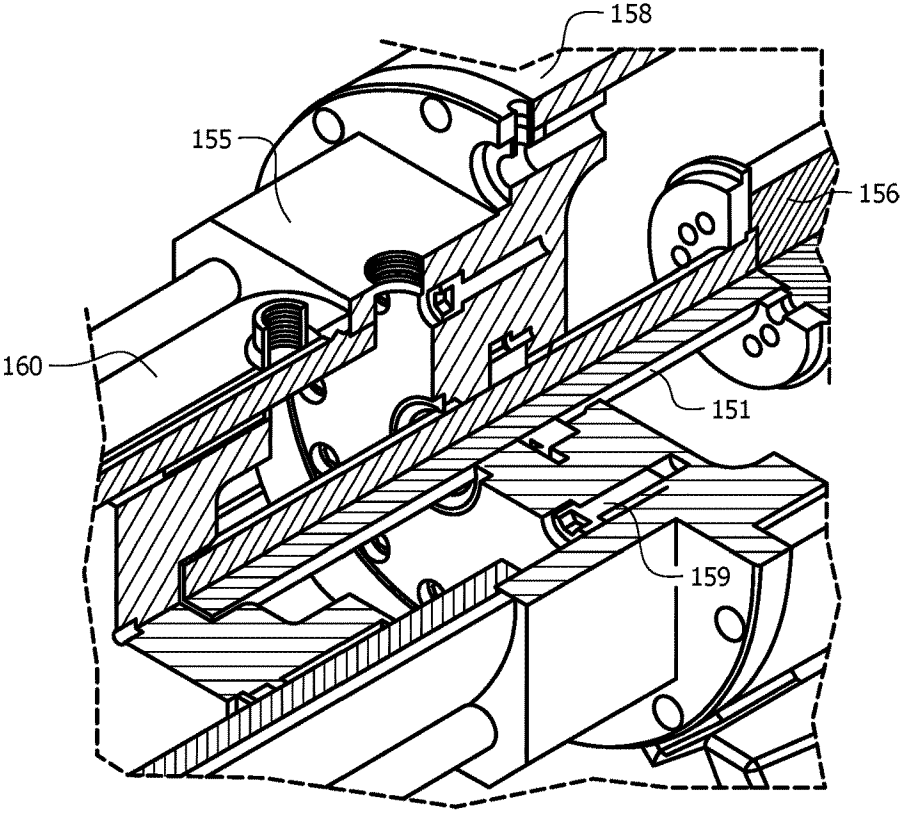
FIG. 7 depicts a perspective view of a low-pressure adapter of the low-pressure cylinder of FIG. 5.

The low-pressure drive piston (166) shown in FIGS. 3 and 5 comprises a dynamic seal and stabilizing bearing (183) on an end portion of the low-pressure drive piston (166) adjacent to the low-pressure chamber (164). For instance, the stabilizing bearing can support the low-pressure drive piston (166) and allow it to translate within the low-pressure cylinder (160). The dynamic seal can seal the low-pressure drive piston (166) while it translates within the low-pressure cylinder (160) to prevent gas in the low-pressure chamber (164) from flowing around the low-pressure drive piston (166) to the motor (150). The low-pressure adapter (155) further comprises a seal (185) surrounding an opening (186) of the low-pressure adapter (155) that receives the low-pressure rod (151). Such a seal (185) may prevent oil ingress to the gas sections of the low-pressure cylinder (160) and/or prevent gas leakage into the motor (150). The low-pressure adapter (155) is coupled with the housing (158) of the motor (150) by fasteners (159), such as screws, bolts, etc., as shown in FIG. 7. For instance, in the illustrated embodiment, twelve bolts are used to retain the low-pressure adapter (155) to the housing (158), but any other suitable number of fasteners can be used. The adapter (155) may be configured to accept multiple diameter cylinders (160) and may provide a piston leak vent path (187). In the illustrated embodiment, the low-pressure chamber (164) of the low-pressure cylinder (160) comprises an outer diameter of about 145 mm, but any other suitable dimensions can be used. In some versions, an outer diameter of about 50 mm can be used. Still other suitable configurations for the low-pressure cylinder (160) will be apparent to one with ordinary skill in the art in view of the teachings herein.

Figure 6:
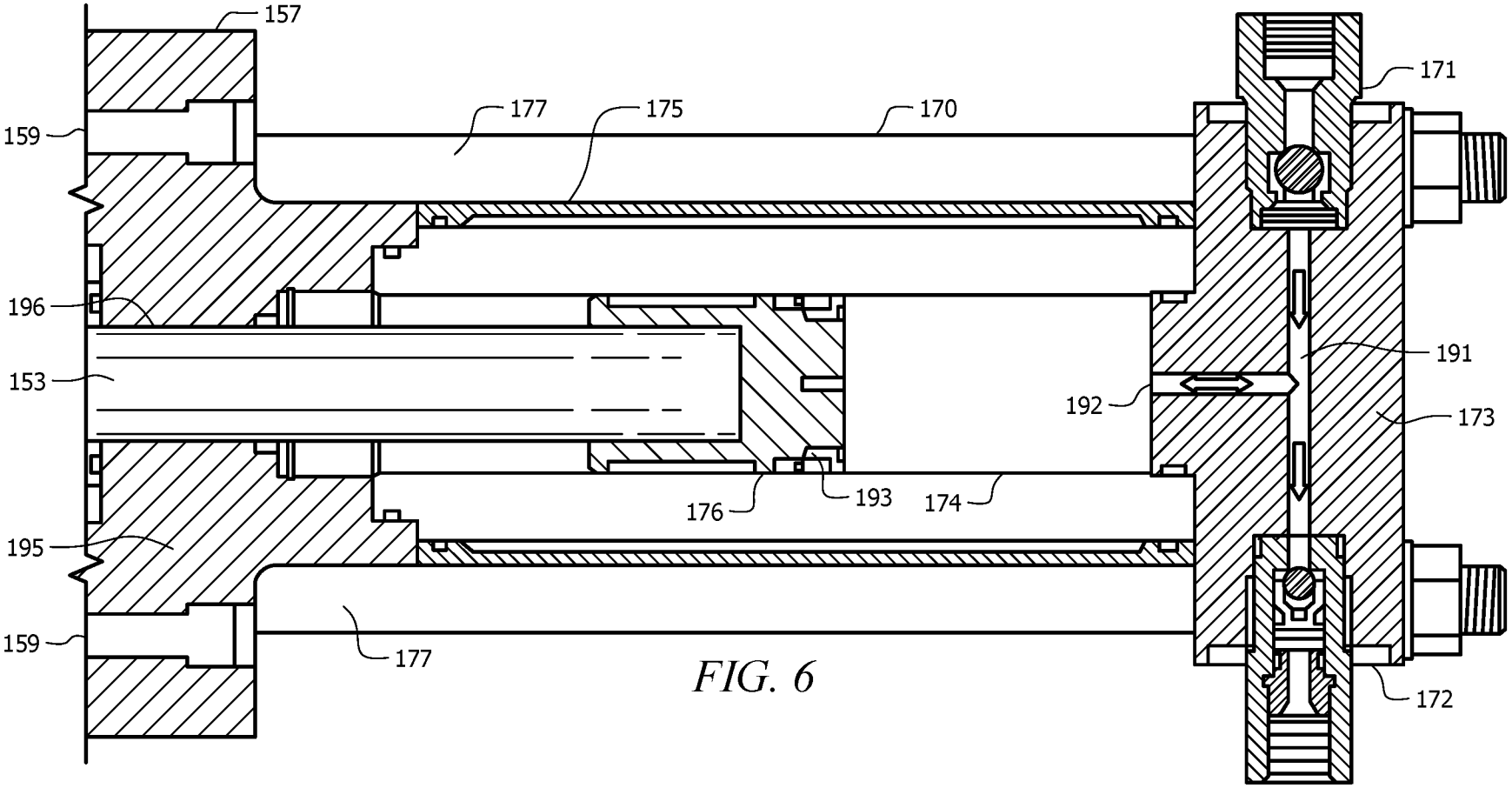
FIG. 6 depicts a cross-sectional view of a high-pressure cylinder of the electric driven gas booster of FIG. 3.

The high-pressure cylinder (170) is shown in more detail in FIGS. 3 and 6. The high-pressure cylinder (170) is similar to the low-pressure cylinder (160) and comprises a high-pressure piston (176) coupled to the other end of the high-pressure rod (153) that translates between a high-pressure end cap (173) and a high-pressure adapter (157) of the high-pressure cylinder (170). A high-pressure chamber (174) is defined between the high-pressure piston (176) and the high-pressure end cap (173). In present embodiment, the high-pressure end cap (173) comprises a high-pressure inlet check valve (171) that allows gas to flow into the high-pressure cylinder (170) from the low-pressure cylinder (160), but not to flow out of the high-pressure cylinder (170). The high-pressure end cap (173) further comprises a first conduit (191) with a first end coupled with the high-pressure inlet check valve (171) and a second end coupled with a high-pressure outlet check valve (172) that allows gas to flow out of the high-pressure cylinder (170), but not into the high-pressure cylinder (170). A second conduit (192) is coupled with the first conduit (191) in the high-pressure end cap (173) between the check valves (171, 172) having an outlet to the high-pressure chamber (174) that allows gas to flow between the high-pressure chamber (174) and the first conduit (191). The high-pressure end cap (173) is attached to the high-pressure adapter (157) of the high-pressure cylinder (170) by tie rods (177). While four tie rods (177) are shown in the illustrated embodiment, any other suitable number of tie rods (177) can be used. In some versions, the high-pressure cylinder (170) comprises a cooling jacket (175) positioned around the high-pressure cylinder (170) to lower the temperature of the gas within the high-pressure cylinder (170).

Figure 8:
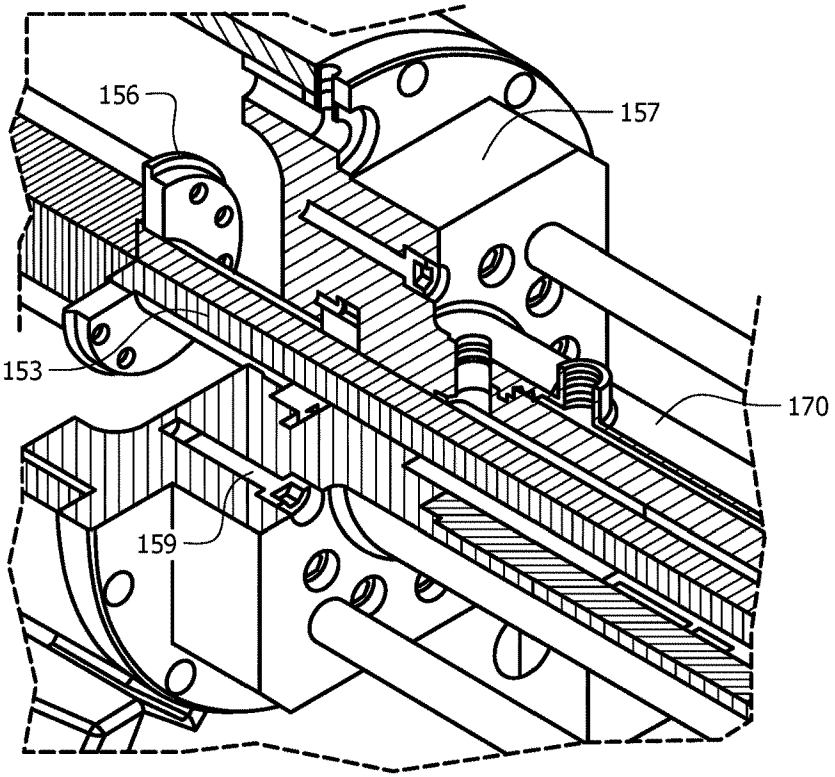
FIG. 8 depicts a perspective view of a high-pressure adapter of the high-pressure cylinder of FIG. 6.

The high-pressure drive piston (166) shown in FIGS. 3 and 6 comprises a dynamic seal and stabilizing bearing (193) on an end portion of the high-pressure drive piston (176) adjacent to the high-pressure chamber (174). For instance, the stabilizing bearing can support the high-pressure drive piston (176) and allow it to translate within the high-pressure cylinder (170). The dynamic seal can seal the high-pressure drive piston (176) while it translates within the high-pressure cylinder (170) to prevent gas in the high-pressure chamber (174) from flowing around the high-pressure drive piston (176) to the motor (150). The high-pressure adapter (157) further comprises a seal (195) surrounding an opening (196) of the high-pressure adapter (157) that receives the high-pressure rod (153). Such a seal (195) may prevent oil ingress to the gas sections of the high-pressure cylinder (170) and/or prevent gas leakage into the motor (150). The high-pressure adapter (157) is coupled with the housing (158) of the motor (150) by fasteners (159), such as screws, bolts, etc., as shown in FIG. 8. The adapter (157) may be configured to accept multiple diameter cylinders (170) and may provide a piston leak vent path (189). In the illustrated embodiment, the high-pressure chamber (174) of the high-pressure cylinder (170) comprises an outer diameter of about 50 mm, but any other suitable dimensions can be used. In some versions, an outer diameter of about 145 mm can be used. For instance, the high-pressure cylinder (170) can be larger, smaller, and/or the same size as the low-pressure cylinder (160). Still other suitable configurations for the high-pressure cylinder (170) will be apparent to one with ordinary skill in the art in view of the teachings herein.

Figure 9:
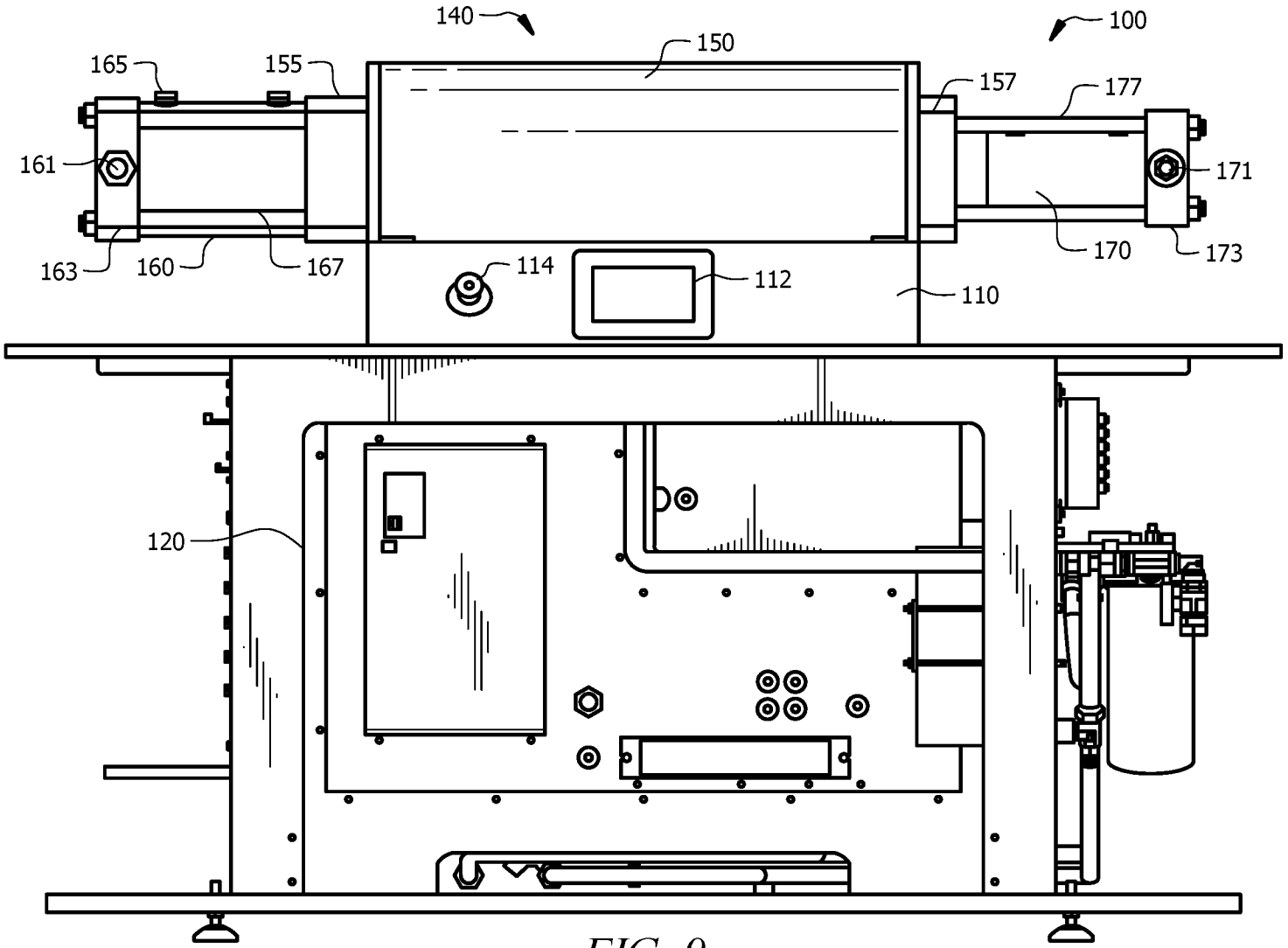
FIG. 9 depicts a front view of the electric driven gas booster assembly of FIG. 2.

As shown in FIG. 9, the booster (140) can be coupled with a controller (110) configured to operate the booster (140). For instance, the controller (110) can be coupled with the drive (156) of the motor (150) to selectively supply electrical energy to the drive (156) to thereby actuate the motor (150). The controller (110) can further comprise a screen (112) to display configurations of the booster (140) and/or to allow a user to operate the booster (140). A stop button (114) can also be provided on the controller (110) to allow a user to stop the booster (140). In some versions, the controller (110) has wireless capabilities that allow the controller (110) to connect to a computer network that can be accessed via the internet. A user can thereby remotely operate the booster (140) and/or remotely view booster configurations, diagnostics, etc. For instance, in some versions, the booster (140) comprises one or more sensors (200) to measure a pressure of the gas to provide feedback to the controller (110) to allow for a closed-loop control of the booster (140). This may allow for stroke position, force, speed, and/or acceleration control that can speed up and/or slow down the booster (140) based on upstream and/or downstream gas parameters. Other suitable configurations for the controller (110) will be apparent to one with ordinary skill in the art in view of the teachings herein. In the illustrated embodiment, the booster (140) is positioned on a cabinet (120) that may store intermediate piping (169) fluidly connecting the low-pressure cylinder (160) with the high-pressure cylinder (170), a heat exchanger (168), and/or a cooling system coupled with the cooling jackets (165, 175) of the cylinders (160, 170). A cooling system for the motor (150) can also be stored in the cabinet (120). Other suitable configurations for the cabinet (120) will be apparent to one with ordinary skill in the art in view of the teachings herein.

Figure 10:
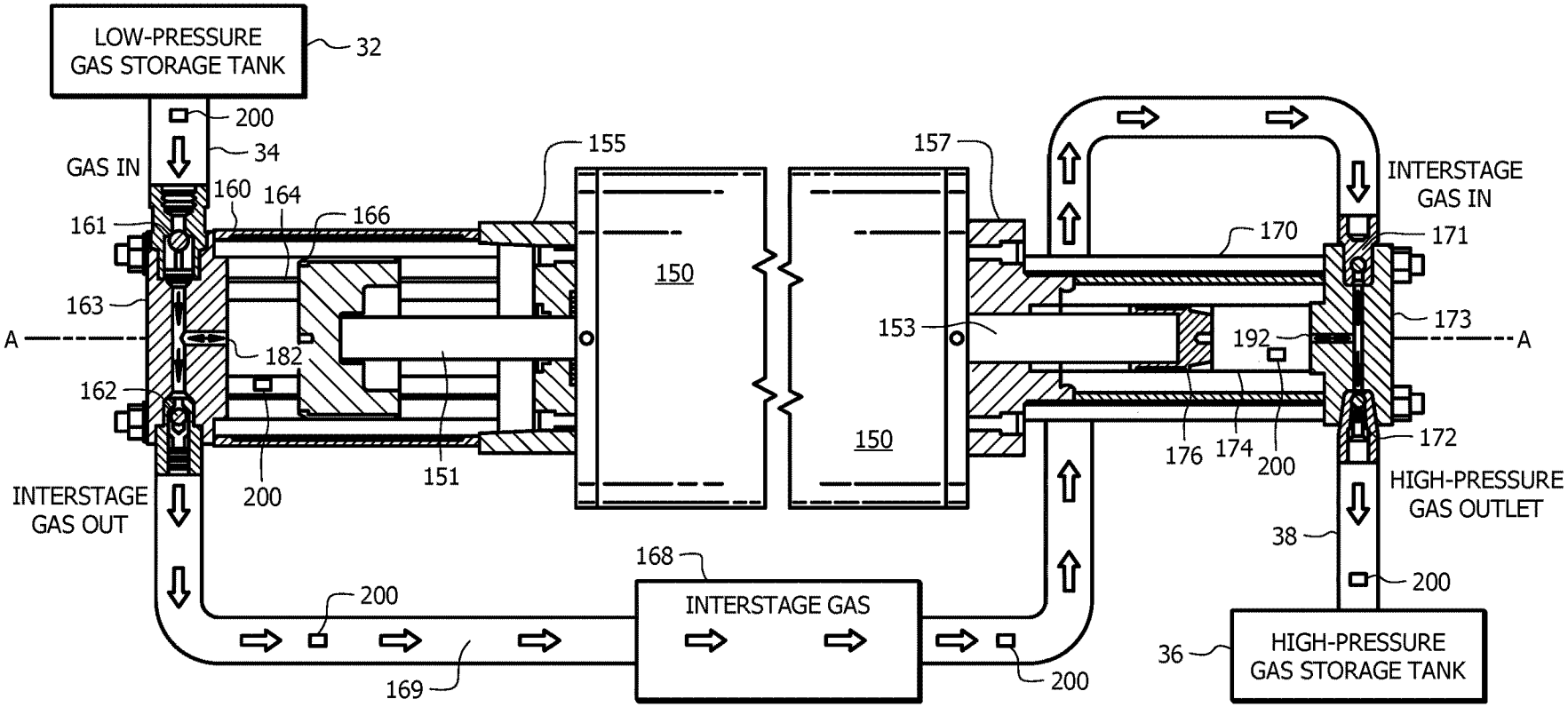
FIG. 10 depicts a schematic of the electric driven gas booster of FIG. 3 showing a gas flow path.

Referring to FIG. 10, an example of a flow path for operating the booster (140) is shown. In the illustrated embodiment, the drive (156) may be electrically actuated by the controller (110) to translate the drive (156) to the right, toward the high-pressure cylinder (170), to thereby actuate the low-pressure piston (166) to the right by the low-pressure rod (151), into the low-pressure cylinder (160). This may draw gas from the low-pressure gas storage tank (32) at a low pressure into the low-pressure gas chamber (164) of the low-pressure cylinder (160) through inlet piping (34) and the low-pressure inlet check valve (161). The drive (156) may then be electrically actuated by the controller (110) to translate the drive (156) in the opposite direction to the left, toward the low-pressure cylinder (160). This may actuate the low-pressure piston (166) to the left, outward in the low-pressure cylinder (160), to compress the gas in the low-pressure gas chamber (164) to an intermediate pressure and to push the gas out of the low-pressure gas chamber (164) through the low-pressure outlet check valve (162). The gas may then travel through intermediate piping (169) and the heat exchanger (168) to the high-pressure cylinder (170). As the low-pressure piston (166) is actuated to the left, the high-pressure piston (176) may also be actuated to the left by the high-pressure rod (153), into the high-pressure cylinder (170), to draw gas from the intermediate piping (169) into the high-pressure gas chamber (174) of the high-pressure cylinder (170) through the high-pressure inlet check valve (171).

The drive (156) may then be electrically actuated by the controller (110) to translate the drive (156) to the right again, toward the high-pressure cylinder (170). This again may actuate the low-pressure piston (166) to the right, into the low-pressure cylinder (160), to draw gas from the low-pressure gas storage tank (32) into the low-pressure gas chamber (164) of the low-pressure cylinder (160). The high-pressure piston (176) may also be translated to the right by the high-pressure rod (153), outward in the high-pressure cylinder (170), to compress the gas in the high-pressure gas chamber (174) to a high pressure and to push the gas out of the high-pressure gas chamber (174) through the high-pressure outlet check valve (172) and to a high-pressure gas storage tank (36) through outlet piping (38). In the illustrated embodiment, the low-pressure cylinder (160), the motor (150), and the high-pressure cylinder (170) are aligned along a longitudinal axis (A). Accordingly, the motor (150) is configured to actuate the pistons (166, 176) along the longitudinal axis (A) via rods (151, 153). The pistons (156, 166, 176) can continue to cycle to thereby produce a stream of high-pressure gas from the booster (140). In some versions, the booster (140) can increase gas pressure from about 100 psi to about 7,000 psi and may be operated between about 0 to about 50 cycles per minute with a maximum temperature of about 300° F. For instance, the pressure of the gas exiting the low-pressure cylinder (160) may be about 808 psi, and the pressure of the gas exiting the high-pressure cylinder (170) may be about 6795 psi. Still other suitable configurations for operating the booster (140) will be apparent to one with ordinary skill in the art in view of the teachings herein.

Figure 11:
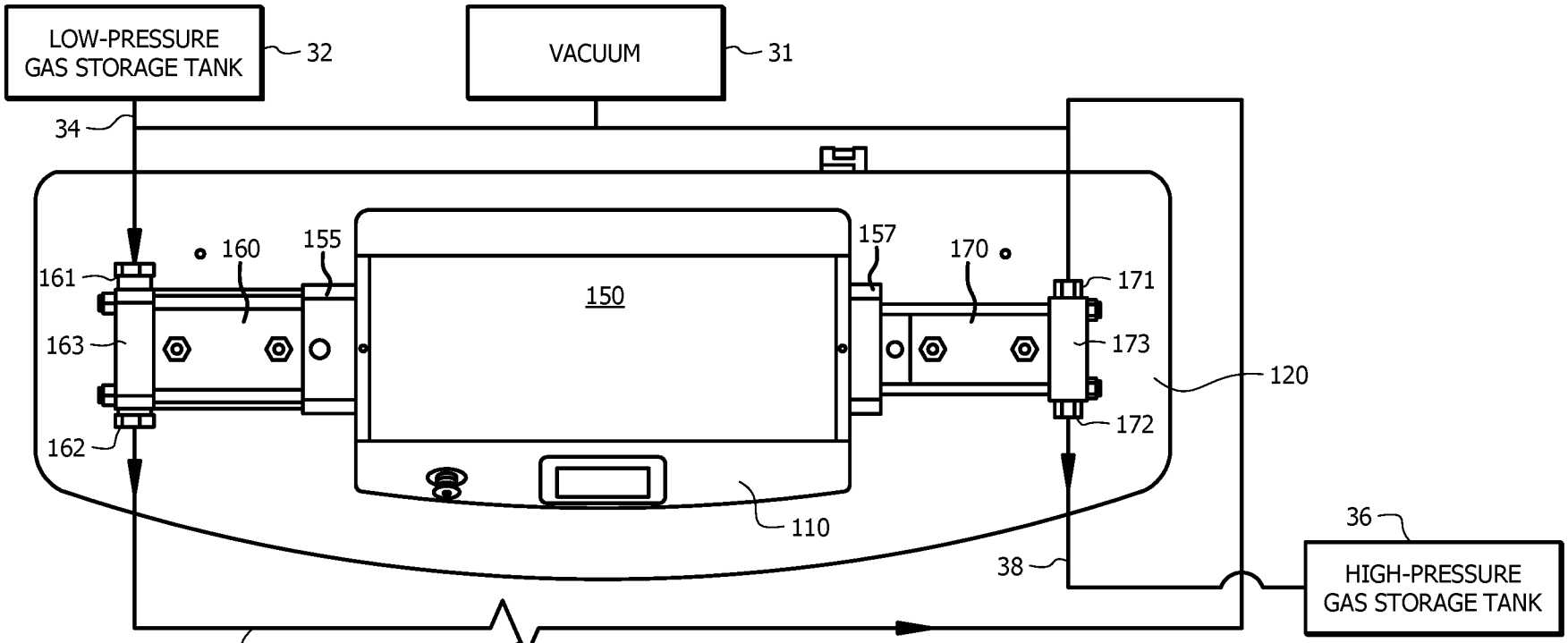
FIG. 11 depicts a schematic of the electric driven gas booster of FIG. 3 with a vacuum.

For instance, as shown in FIG. 11, a vacuum (31) can be coupled with an inlet (161, 171) of one or both of the cylinders (160, 170) such that the booster (140) may be configured to draw vacuum. The vacuum may comprise any pressure below atmospheric pressure. This may allow the booster (140) to be used in different applications, such as for refrigerant systems. This may also be used on a one-stage and/or two-stage booster (140). In some versions, the pressure of the gas exiting the high-pressure cylinder (170) may be up to about 15,000 psi.

Figure 12:
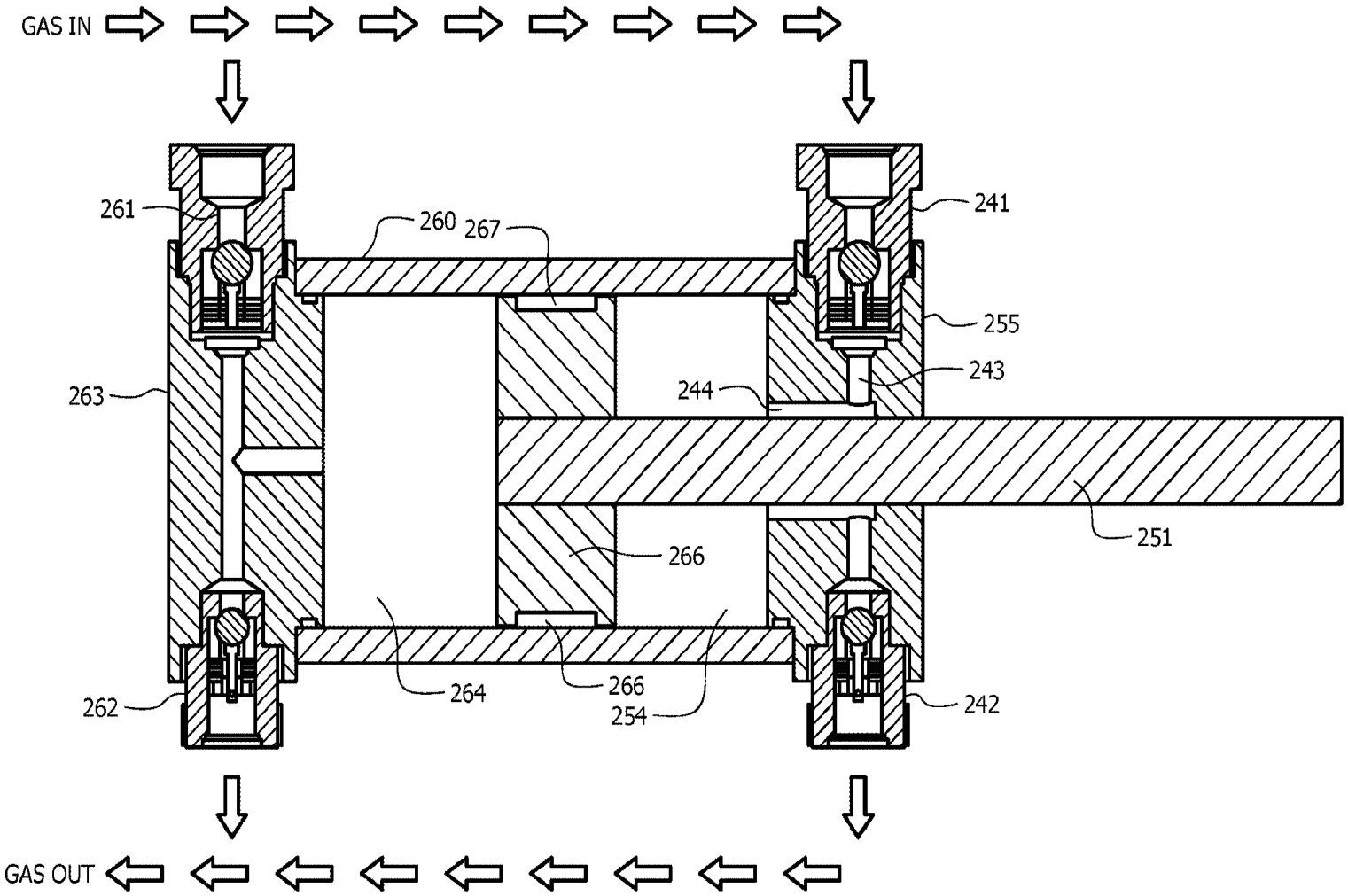
FIG. 12 depicts a schematic of a gas cylinder for use with the electric driven booster of FIG. 3.

In some versions, the booster (140) is configured as a double-acting booster (140). FIG. 12 shows a double-acting gas cylinder (260) that may be incorporated into the booster (140) described above in a one stage and/or two stage application. The cylinder (260) is similar to the cylinders (160, 170) described above, except that the cylinder (260) comprises a second pair of one-way check valves (241, 242) on the opposing side of the piston (266) from the other check valves (261, 262) on end cap (263) to form a second chamber (254) in the interior portion of the cylinder (260). The second inlet check valve (241) and the second outlet check valve (242) allow gas to flow out of the second chamber (254), but not into the second chamber (254). The second pair of check valves (241, 242) are positioned on an adaptor (255) that can be used to couple the cylinder (260) to the motor (150). The adapter (255) further comprises a first conduit (243) with a first end coupled with the inlet check valve (241) and a second end coupled with the outlet check valve (242) that allows gas to flow out of the cylinder (260), but not into the cylinder (260). A second conduit (244) is coupled with the first conduit (243) in the adapter (255) between the check valves (241, 242) having an outlet to the second chamber (254) that allows gas to flow between the second chamber (254) and the first conduit (243). The second conduit (244) is positioned around the rod (251) coupled with the drive (156). The piston (266) of the cylinder (260) further comprises a bi-directional seal (267). Still other suitable configurations for the double-acting cylinder (260) will be apparent to one with ordinary skill in the art in view of the teachings herein.

Accordingly, when the piston (266) is actuated to the left to compress the gas in the first chamber (264) and push the gas out of the first chamber (264) through the first outlet check valve (262), gas is also drawn into the second chamber (254) through the second inlet check valve (241). When the piston (266) is then actuated in the opposing direction to draw gas into the first chamber (264) through the first inlet check valve (261), the gas in the second chamber (254) is compressed and pushed out of the second chamber (254) through the second outlet check valve (242). This allows the booster (140) to work to compress gas when the piston (266) is translated in both directions.

Accordingly, an electric driven gas booster (140) is more efficient by providing a direct mechanical connection between an integrated electric motor (150) and the gas pistons (166, 176) to eliminate the need for a separate fluid energy system, such as a pneumatic or hydraulic drive system. Such an electric drive for the booster (140) increases the cycle speed and allows the cycle speed to be more easily regulated. This may thereby reduce equipment costs and/or eliminate energy losses due to pneumatic and hydraulic pressure drops.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A gas booster for increasing a pressure of a gas comprising:

a first gas cylinder comprising:

a first piston having a first rod;

a first chamber and a second chamber positioned on an opposing side of the first piston from the first chamber;

an end cap at a first end portion of the first chamber, the end cap comprising a first inlet check valve, a first outlet check valve, a first conduit, and a second conduit, an end of the first conduit being coupled to the first inlet check valve and another end of the first conduit being coupled to the first outlet check valve, the second conduit being coupled to the first conduit and having an outlet to the first chamber; and an adapter at a second end portion of the first chamber that couples the first gas cylinder to a drive housing that houses a drive that drives the first piston, the adapter comprising a second inlet check valve, a second outlet check valve, a third conduit, and a fourth conduit, an end of the third conduit being coupled to the second inlet check valve and another end of the third conduit being coupled to the second outlet check valve, the fourth conduit surrounding at least a portion of the first rod at a central portion of the adapter and extending along an axis of the first rod, the fourth conduit being coupled to the third conduit and having an outlet to the second chamber, wherein the end cap is attached to the adapter by a plurality of tie rods that maintain a position of the end cap relative to the adapter, wherein the first piston is actuatable within the first gas cylinder to: (a) draw the gas into the first chamber through the first inlet check valve at a first pressure and to push the gas out of the first chamber through the first outlet check valve at a second pressure that is higher than the first pressure; and (b) draw the gas into the second chamber through the second inlet check valve at the first pressure and to push the gas out of the second chamber through the second outlet check valve at a third pressure that is higher than the first pressure; and wherein the drive comprises an electric motor configured to convert electric energy to a linear motion, wherein the electric motor is coupled to the first piston of the first gas cylinder by the first rod to actuate the first piston.

2. The gas booster of claim 1, wherein the electric motor comprises a ball screw drive.

3. The gas booster of claim 1, wherein the first rod comprises a first end and a second end, wherein the first end is coupled with the electric motor and the second end is coupled with the first piston of the first gas cylinder such that the first piston is configured to translate with the linear motion of the electric motor.

4. The gas booster of claim 1, wherein the first inlet check valve comprises a first one-way check valve configured to allow gas to flow into the first gas cylinder, and the first outlet check valve comprises a second one-way check configured to allow gas to flow out of the first gas cylinder.

5. The gas booster of claim 1, wherein the first gas cylinder comprises a cooling jacket positioned around the first chamber configured to lower a temperature of the gas within the first chamber.

6. The gas booster of claim 1, wherein the gas booster comprises a second gas cylinder comprising:

a third chamber having a third inlet and a third outlet; and a second piston actuatable within the second gas cylinder, wherein the second piston is configured to draw the gas outputted through the first outlet check valve or the second outlet check valve of the first gas cylinder into the third chamber through the third inlet and to push the gas out of the third chamber through the third outlet at a fourth pressure that is higher than the second pressure or the third pressure, wherein the electric motor is coupled to the second piston of the second gas cylinder by a mechanical connection to actuate the second piston.

7. The gas booster of claim 6, wherein the mechanical connection comprises a second rod having a first end and a second end, wherein the first end is coupled with the electric motor and the second end is coupled with the second piston of the second gas cylinder such that the second piston is configured to translate with the linear motion of the electric motor.

8. The gas booster of claim 6, wherein the gas booster comprises piping fluidly coupling the first outlet check valve and the second outlet check valve of the first gas cylinder with the third inlet of the second gas cylinder, wherein the piping comprises a heat exchanger configured to cool a temperature of the gas between the first gas cylinder and the second gas cylinder.

9. The gas booster of claim 6, wherein one or both of the first gas cylinder and the second gas cylinder is configured to draw in vacuum.

10. The gas booster of claim 1, further comprising:

a controller programmable to selectively activate the electric motor to thereby actuate the first piston.

11. The gas booster of claim 10, wherein the controller is programmable to selectively control a select one or more of a position of the first piston, a maximum force of the first piston, a speed of the first piston, and an acceleration of the first piston.

12. The gas booster of claim 10, wherein the controller comprises wireless capabilities to allow a remote connection to the controller via the internet.

13. The gas booster of claim 10, wherein the gas booster comprises at least one pressure sensor configured to measure a pressure of the gas booster, wherein the controller is programmable to selectively actuate the first piston based on the measured pressure from the at least one pressure sensor.

14. The gas booster of claim 1, further comprising a bi-directional seal disposed between the first piston and the first gas cylinder.

* * * * *